United States Patent [19]

Kanamori et al.

[11] Patent Number: 4,946,612

[45] **Date of Patent: * Aug. 7, 1990**

[54] LUBRICATING OIL COMPOSITION FOR SLIDING SURFACE AND FOR METALLIC WORKING AND METHOD FOR LUBRICATION OF MACHINE TOOLS USING SAID COMPOSITION

[75] Inventors: Hideo Kanamori; Katumi Hasimoto, both of Ichihara, Japan

[73] Assignee: Idemitsu Kosan Company Limited, Tokyo, Japan

[ * ] Notice: The portion of the term of this patent subsequent to Nov. 1, 2005 has been disclaimed.

[21] Appl. No.: 55,522

[22] Filed: May 29, 1987

[30] Foreign Application Priority Data

Jun. 9, 1986 [JP] Japan ..... 61-133123

[51] Int. Cl.[5] ..... C10M 173/00; C10M 133/16

[52] U.S. Cl. ..... 252/49.5; 252/51.5 A

[58] Field of Search ..... 252/51.5 A, 49.5

[56] References Cited

U.S. PATENT DOCUMENTS

| | | | |
|---|---|---|---|
| 3,024,195 | 3/1962 | Drummond et al. | 252/51.5 A |
| 3,024,237 | 3/1962 | Drummond et al. | 252/51.5 A |
| 3,219,666 | 11/1965 | Norman et al. | 544/383 |
| 3,281,358 | 10/1966 | Furey | 252/51.5 A |
| 3,310,492 | 3/1967 | Benoit, Jr. | 252/51.5 A |
| 3,424,684 | 1/1969 | Hellmuth | 252/51.5 A |
| 4,100,082 | 7/1978 | Clason et al. | 252/51.5 A |
| 4,105,571 | 8/1978 | Shaub et al. | 252/51.5 A |
| 4,368,133 | 1/1983 | Forsberg | 252/49.5 |
| 4,396,516 | 8/1983 | Kinoshita et al. | 252/51.5 A |
| 4,781,846 | 11/1988 | Kanamori | 252/49.5 |

*Primary Examiner*—William R. Dixon, Jr.
*Assistant Examiner*—Jerry D. Johnson
*Attorney, Agent, or Firm*—Browdy and Neimark

[57] ABSTRACT

Disclosed is a lubricating oil composition both for lubrication of sliding surface of machine tools and for lubrication of working part of machine tools which is free from the conventional problems. This composition comprises a reaction product of a dibasic acid of 16–24 carbon atoms with a piperazine compound, a lubricating oil, an emulsifier and, if necessary, an extreme pressure agent and/or an oiliness agent.

19 Claims, No Drawings

LUBRICATING OIL COMPOSITION FOR SLIDING SURFACE AND FOR METALLIC WORKING AND METHOD FOR LUBRICATION OF MACHINE TOOLS USING SAID COMPOSITION

FIELD OF THE INVENTION

This invention relates to a lubricating oil composition used for sliding surfaces and for metallic working which comprises a reaction product of a dibasic acid of 16–24 carbon atoms with a piperazine compound, a lubricating oil and an emulsifier and method for lubrication of machine tools using said composition.

BACKGROUND OF THE INVENTION

Generally, sliding surface lubricating oil compositions used for machine tools and lubricating oil compositions for metal working such as cutting oil and grinding oil differ of their compositions from each other. However, ordinary machine tools are in such designs so that both of these oil compositions are apt to mix with each other, resulting in the problems of reduction of performance and unsatisfactory function due to the mixing of different oils.

The applicants have proposed a lubricating oil composition for combined use which comprises a lubricating oil such as mineral oil, synthetic oil or the like and a specific long chain carboxylic acid to solve the above problems (Japanese Patent Unexamined Publication (Kokai) No. 141793/86). This lubricating oil composition is an excellent oil composition for combined use which is substantially free from the above problems, but further improvement in sliding surface characteristics is required.

SUMMARY OF THE INVENTION

Accordingly, the object of this invention is to provide a novel oil composition for combined use which is free from the above problems and improved over that of Japanese Patent Unexamined Publication (Kokai) No. 141793/86, that is, the present oil composition is markedly superior in both its performance as a sliding surface oil and as a cutting and grinding oil. The present composition causes no troubles in performances due to mixing of the cutting oil and the sliding surface oil with each other even when the sliding oil and the cutting and grinding oil are used at the same composition (for example, undiluted basic oil is used for sliding surface oil and its emulsion is used for cutting and grinding oil) in machine tools which use sliding surface oil and metal working oil such as cutting and grinding oil, especially, in a lubricating system where the sliding surface oil is used in total consumption system and the cutting and grinding oil is used in circulating system.

The outline of a first aspect of the invention for attaining the above object is a lubricating oil composition used for both sliding surface lubrication and metal working and which comprises a reaction product of a dibasic acid of 16–24 carbon atoms with a piperazine compound, a lubricating oil and an emulsifier.

The outline of a second invention is a aspect of the lubricating oil composition used for both sliding surface lubrication and metal working which comprises a reaction product of a dibasic acid of 16–24 carbon atoms with a piperazine compound, a lubricating oil, an emulsifier and, if necessary, an extreme pressure agent and/or an oiliness agent.

The outline of a third aspect of the invention is a method for lubrication of machine tools which comprises applying to a sliding surface of machine tools a lubricating oil composition for both sliding surface lubrication and metal working which comprises a reaction product of a dibasic acid of 16–24 carbon atoms with a piperazine compound, a lubricating oil, an emulsifier and, if necessary, an extreme pressure agent and/or oiliness agent a and applying the diluted composition to a metal working part.

DETAILED DESCRIPTION OF THE INVENTION

The lubricating oil used in this invention has no special limitation and there may be used any of petroleum oil or mineral oil lubricating oils (paraffinic oils and/or naphthenic oils, etc.), non-petroleum lubricating oil (synthetic lubricating oil, animal oils, vegetable oils, etc.), etc., furthermore, light lubricating oils, medium lubricating oils, heavy lubricating oils and their base oils such as mineral oils, synthetic oils, animal oils, vegetable oils, etc. Preferred are those having a viscosity within the range of 5–500 cst (40° C.).

As more specific examples thereof, mention may be made of lubricating oils for metal working (e.g., rolling oil, cutting oil, grinding oil, plastic working oil, pressing oil, drawing oil, etc.), actuation lubricating oils (e.g., aircraft actuation oil, automobile brake oil, hydraulic-actuation oil, torque converter oil, etc.), rust resisting lubricating oils, industrial lubricating oils, spindle oils, refrigeration machine oils, dynamo oils, turbine oils, machine oils, cylinder oils, various gear oils, automatic transmission oils, various internal combustion engine lubricating oils, various sliding surface oils, etc. and mineral oils, synthetic oils, animal and vegetable oils used for these lubricating oils. Among these oils, the preferred oils are cutting oils, grinding oils, cutting and grinding oils and various sliding surface oils and mineral oils and synthetic oils used therefor a and especially preferred are cutting and grinding oils for circulation systems, sliding surface oils for totally consuming systems and mineral oils and synthetic oils used therefor.

Said mineral oils include, for example, naphthenic mineral oils, intermediate mineral oils, paraffinic mineral oil lubricant fractions and higher aromatics obtained by refining of these mineral oils. Said synthetic oils include, for example, long chain alkylbenzenes, branched alkylbenzenes, polyolefin oils such as polybutene, and $\alpha$-olefine oligomer etc., alkylnaphthalenes, ester oils, polyglycol oils, etc. Among these oils, naphthenic mineral oils and $\alpha$-olefin oligomers are preferred as lubricating oils.

These lubricating oils may be used alone or in combination of two or more. Furthermore, if necessary, they may be used in emulsion form.

These lubricating oils may contain antioxidants, antifoamers, metal deactivators, cleaning agents, viscosity modifiers, rust proof additives and in some cases, additives such as extreme pressure agents, water repellants, tackiness agents, colorants, etc.

Examples of dibasic acids of 16–24 carbon atoms are as follows.

$$HOOC(CH_2)_5\underset{\underset{C_2H_5}{|}}{CH}(CH_2)_6COOH,$$

-continued $$HOOC(CH_2)_5\underset{\underset{C_2H_5}{|}}{C}H(CH_2)_{10}COOH,$$

$$HOOC(CH_2)_6CH{=}CH(CH_2)_6COOH,$$
$$HOOC(CH_2)_6CH{=}CH(CH_2)_2CH{=}CH(CH_2)_6COOH,$$

$$HOOC(CH_2)_5\underset{\underset{CH{=}CH_2}{|}}{C}H(CH_2)_6COOH,$$

$$HOOC(CH_2)_5\underset{\underset{CH{=}CH_2}{|}}{C}H(CH_2)_2CH{=}CH(CH_2)_6COOH,$$

$$HOOC(CH_2)_6C(CH_3{=}CH{-}(CH_2)_2CH{=}C(CH_3){-}(CH_2)_6COOH$$

Preferred are saturated or unsaturated long chain dibasic acids of 16–24 carbon atoms which have carboxyl groups at both ends of a molecular chain, more preferred are saturated long chain, dibasic acids of 16–24 carbon atoms which have carboxyl groups at both ends of a molecular chain and the most preferred is $$HOOC(CH_2)_5\underset{\underset{C_2H_5}{|}}{C}H(CH_2)_{10}COOH.$$

The piperazine compounds used in this invention are piperazine or its derivatives represented by the following general formula [1]:

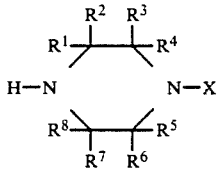

[1]

wherein $R^1$–$R^8$ each represents hydrogen atom; hydrocarbon group such as alkyl, aryl, araryl, aralkyl group or the like, hydroxyl group, halogen atom, alkoxy group, amino group, alkylamino group, dialkylamino group; halogen atom and/or hydroxyl group and/or alkoxy group and/or amino group substituted hydrocarbon group such as alkylaminoalkyl group, dialkylaminoalkyl group, hydroxyalkyl group, hydroxyaryl group, aminoaryl group, alkylaminoaryl group, alkoxyalkyl group, alkoxyaryl group, or the like and X represents hydrogen atom; hydrocarbon group such as alkyl, aryl, araryl, aralkyl or the like; hydroxyl, amino group, halogen atom or alkoxy group substituted hydrocarbon group such as hydroxyalkyl, aminoalkyl, haloalkyl, alkoxyalkyl, hydroxyaryl, hydroxyararyl, hydroxyaralkyl, aminoaryl, aminoaralkyl or the like.

Among the piperazine compounds represented by the formula [1], those represented by the following general formula [2] are preferred.

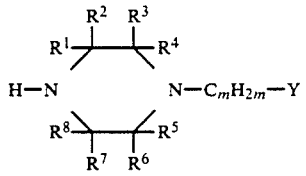

[2]

wherein $R^1$–$R^8$ are the same as defined above, Y represents OH or $NH_2$ and m represents an integer of 1–5, preferably 2 or 3.

$R^1$–$R^8$ in the general formulas [1] and [2] are preferably hydrogen atom, alkyl groups of 1–5 carbon atoms (especially methyl group), hydroxyalkyl groups of 1–5 carbon atoms (especially 2-hydroxyethyl group) or aminoalkyl groups of 1–5 carbon atoms (especially 2-aminoethyl group).

The substitution position of Y, namely, OH or $NH_2$ in $-C_mH_{2m}-$ has no special limitation, but suitably is that represented by $-CH_2-C_{m-1}H_{2(m-1)}-Y$ when m is an integer of 2–5 and especially suitable is that represented by $-CH_2CHY-R'$ (where R' represents hydrogen atom or an alkyl group of 1–3 carbon atoms).

Y is especially suitably OH.

Among the piperazine compounds represented by the general formula [2], examples of those which may be relatively suitably used are as follows: N-hydroxyalkylpiperazines such as N-(hydroxymethyl)piperazine, N-(hydroxymethyl)-2-methylpiperazine, N-(2-hydroxyethyl)piperazine, N-(2-hydroxyethyl)-2-methylpiperazine, N-(2-hydroxyethyl)-2-hydroxyethylpiperazine, N-(2-hydroxyethyl)-2-aminoethylpiperazine, N-(2-hydroxyethyl)-2, 3-dimethylpiperazine, N-(2-hydroxypropyl)piperazine, N-(2-hydroxypropyl)-2-methylpiperazine, N-(2-hydroxypropyl)-2-hydroxyethylpiperazine, N-(3-hydroxypropyl)piperazine, N-(3-hydroxypropyl)-2-methylpiperazine, N-(2-hydroxybutyl)piperazine, N-(2-hydroxybutyl)-2-methylpiperazine, N-(2-hydroxybutyl)-2-hydroxyethylpiperazine, N-(4-hydroxybutyl)piperazine, N-(2-hydroxypentyl)piperazine, N-(5-hydroxypentyl)piperazine, N-(2-hydroxy-2-methylpropyl)piperazine, N-(2-hydroxyisoamyl)piperazine, etc.; N-aminoalkylpiperazines such as N-(aminomethyl)piperazine, N-(2-aminoethyl)piperazine, N-(2-aminoethyl)-2-methylpiperazine, N-(2-aminoethyl)-2-hydroxyethylpiperazine, N-(2-aminoethyl)-2-aminoethylpiperazine, N-(2-aminopropyl)piperazine, N-(2-aminopropyl)-2-methylpiperazine, N-(3-aminopropyl)piperazine, N-(3-aminopropyl)-2-methylpiperazine, N-(2-aminobutyl)piperazine, N-(3-aminobutyl)piperazine, N-(4-aminobutyl)piperazine, N-(2-aminopentyl)piperazine, N-(5-aminopentyl)piperazine, N-(5-aminopentyl)-2-hydroxyethylpiperazine, etc.

In addition to these compounds, as examples of piperazine compounds represented by the formula [1], mention may be made of, for example, piperazine 2-(2-hydroxyethyl)piperazine, 2-methylpiperazine, 2-(2-aminoethyl)piperazine, N-methylpiperazine, N-methyl-2-hydroxymethylpiperazine, N-phenylpiperazine, N-(hydroxyphenyl)piperazine, N-(hydroxycyclohexyl)-piperazine, N-benzylpiperazine, N-(hydroxybenzyl)piperazine, N-(hydroxymethylphenyl)piperazine, N-phenyl-2-hydroxyethylpiperazine, etc.

Among these compounds, N-(2-hydroxyalkyl)piperazines are preferred and N-(2-hydroxyethyl)piperazine and N-(2-hydroxypropyl)piperazine are especially preferred.

According to this invention, said piperazine compound (component [B1]) and said long chain dibasic acid of 16–24 carbon atoms (component [B2]) are blended to produce a reaction product and this reaction product or a solution of this reaction product is used for preparation of a lubricating oil composition capable of being used for both the sliding surface and metallic working.

Blending ratio of the component [B1] and the component [B2] for the reaction is usually 0.5–10 mols, preferably 1–5 mols of the component [B1] per 1 mol of the component B2.

Reaction of component [B1] and component [B2] may be carried out, for example, at a reaction temperature of room temperature–200° C., preferably 30°–100° C. and for a reaction time of 5–120 minutes, preferably 10–60 minutes.

The emulsifier used in this invention has no limitation and as examples thereof, mention may be made of, for example, anionic surfactants such as aliphatic soaps, naphthenic soaps, sulfuric acid esters of long chain alcohols, aliphatic alkylsulfuric acid esters, etc.; cationic surfactants such as long chain primary amines, alkyltrimethylammonium salts, etc.; nonionic surfactants such as polyoxyethylene alkyl ether, polyoxyethylene alkylphenyl ether, polyoxyethylene alkyl ester, polyoxyethylene alkylphenyl ester, etc.; phosphorus-containing surfactants such as dipolyoxyethylene alkyl ether phoshate, tripolyoxyethylene alkyl ether phosphate, tripolyoxyethylene alkyl phenyl ether phosphate, etc. These emulsifiers may be added in an amount of 5–30% by weight, preferably 10–20% by weight of the total weight. When the amount of emulsifier is less than 5% by weight, the resultant lubricating oil composition separates into components and cannot be used as sliding surface lubricating oil and besides also cannot be used for metal working because of poor emulsion stability of metal working composition. On the other hand, when more than 30% by emulsifier is used weight, stick slip occurs when the composition is used as a sliding surface lubricating oil composition.

The extreme pressure agents used in this invention have no special limitation and there may be used any known extreme pressure agents used in lubricating oils.

Typical examples thereof are sulfur compound extreme pressure agents such as sulfurized lard, sulfurized sperm oil, etc., phosphorus compound extreme pressure agents such as phosphoric acid esters, phosphoric ester amine salts, chlorine compound extreme pressure additives, etc.

The oiliness agents used in this invention have also no special limitation and there may be used any known oiliness agent used in lubricating oils. Typical examples thereof are higher alcohols, higher ketones, higher fatty acid esters, fatty acid esters of polyhydric alcohols such as fats and oils, phosphoric acid esters, amine salts of phosphoric acid esters, etc.

Generally, both the oiliness agents and the extreme pressure agents are for improving boundary lubrication and clear distinction between the two is considered difficult. [See "Lubrication Handbook" edited by Japan Lubrication Society and published by Yokendo (1982)]. Therefore, the above enumerated extreme pressure agents and oiliness agents can be considered as extreme pressure and oiliness agent.

Among the extreme pressure and oiliness agent enumerated hereabove, preferred are sulfurized lard, sulfurized sperm oil, phosphoric acid esters, amine salts of phosphoric acid esters, fatty acid esters, higher fatty acid esters of polyhydric alcohols such as fats and oils, etc. and especially preferred are sulfurized lard, amine salts of phosphoric acid esters, etc.

These extreme pressure agents and oiliness agents or extreme pressure and oiliness agents may be used alone or in combination of two or more.

The lubricating oil composition used for both the sliding surface lubrication and the working of metals may be prepared by mixing said lubricating oil (component [A]), said reaction product (component [B]) of said component [B1] and said component [B2], said extreme pressure agent and/or oiliness agent namely, said extreme pressure and oiliness agent (component [C]) and said emulsifier (component [D]) or by mixing said component [A], said component [B] and said component [D].

Mixing ratios of these components are set as follows:

When amount of component [B] is less than 2 parts by weight, rust proofness, bacteria resistance, stain resistance, corrosion resistance and wear resistance are insufficient or when used as sliding surface oil, kinitic coefficient of friction is not decreased or stick slip occurs when surface pressure is high. On the other hand, even if component [B] is mixed in an amount of more than 60 parts by weight, increase of effects cannot be expected and so addition of such amount is not economical.

That is, it is desired to set the mixing ratios as follows: [B] component 2–60%, preferably 5–30% by weight, component [C] 0–30%, preferably 2–20% by weight, and component [D] 3–30%, preferably 5–20% by weight for component [A], respectively. Sum of components [A]–[D] is naturally 100% by weight.

When mixing ratio of component [D] is less than 3% by weight, emulsion stability of metal working solution is deteriorated and when more than 30% by weight, lubricity is reduced.

When mixing ratio of component [C] is more than 30% by weight, oil stains and corrosion are apt to occur. Usually, the component [C] is added mainly for improvement of boundary lubricity and the sliding surface and metal working lubricating oil composition of this invention exhibits excellent boundary lubricity even if it contains no or a little component [C]. The reason is not clear at present, but it is supposed that component [B] per se also possesses that property.

The sequence and method of mixing of these components have no special limitation and they may be added simultaneously, stepwise or in partial combination. For example, when a sliding surface and metal working lubricating oil composition containing component [C] is prepared, if lubricating oil used contains component [C], this lubricating oil may be mixed with component [B] and component [D]. Further, if necessary, component [C] may be added separately.

The lubricating oil composition for sliding surface and for metal working of this invention desirably contains additives commonly used in lubricating oils for mechanical working such as antioxidant, antifoamer, copper activating agent. etc. Furthermore, the lubricating oil composition may contain other additives, for example, cleaning agent, viscosity modifier (e.g., viscosity index improver, pour point depressant, etc.), rust proofing agent, water repellant, tackiness agents colorant, etc. Sequence and method of addition of these additives have no special limitation and, for example, they may be previously contained in the lubricating oil or they may be added separately.

The antioxidants include, for example, phenolic compounds such as 2, 6-di-tertiary-butylparacresol, etc., amine compounds such as phenyl-α-naphthylamine, etc., and sulfur compounds, phosphorus compounds, etc.

The antifoamers include, for example, silicone compounds such as dimethylpolysiloxane, etc., alcoholic compounds, ester compounds, etc.

The copper activating compounds include, for example, triazole compounds such as benzotriazole, etc., thiazole compounds, etc.

The lubricating oil composition of combined use, namely, used for both the lubrication of sliding surface and the metal working obtained by the method as mentioned above can be used, as it is, as sliding surface oil or in the form of an aqueous mixture with water or emulsion as metal working solution. These aqueous mixture or emulsion can be prepared, for example, by adding 2–100 parts by weight of water for one part by weight of the undiluted composition of this invention.

The lubricating oil composition of this invention possesses excellent properties such that when used as is without dilution as a sliding surface oil, the kinetic coefficient of friction is low and beside it causes no stick slip even when the pressure of the sliding surface is high. On the other hand, when the composition as a it is or diluted with water is used as cutting and grinding oil, it exhibits excellent properties in that it provides markedly excellent wear resistance and it is high in emulsifiability and solubilizability and high in stability and thus is suitable as an aqueous lubricating composition.

In addition to the above advantages, the lubricating oil composition of this invention is superior in secondary properties such as rust proofness, oil stain resistance, corrosion resistance, germ resistance (such as bacteria resistance, fungus resistance), rot resistance, etc. in both the uses as sliding surface oil and metal working oil.

As explained hereabove, the lubricating oil composition used for both the lubrication of sliding surface and the lubrication in metal working of this invention is a lubricating oil of combined use which is excellent in properties as a sliding surface oil as a cutting and grinding oil. Therefore, it can be suitably used concurrently as a sliding surface oil and a cutting and grinding oil in machine tools which use sliding surface oil and cutting and grinding oil, especially in lubricating system of machine tools which use sliding surface oil in totally consuming system and cutting and grinding oil in circulating system. In this case, for example, the sliding surface and metal working lubricating oil composition of this invention can be used, as it is, as a sliding surface oil and can be used in the form of emulsion as a cutting and grinding oil. In this way, by using excellent oils of combined use of basically the same composition for lubrication of sliding surface and for metal working, it becomes possible to remove the problems such as reduction of performances of the oils and inferior actuation which are caused by mixing of the oils with each other.

That is, the sliding surface and metal working lubricating oil composition of this invention is an excellent lubricating oil composition for machine tools which can be suitably used as a sliding surface oil and as a metal working oil such as cutting and grinding oil and further as an oil for both was as the sliding surface oil and metal working oil.

According to this invention, there is provided a sliding surface and metal working lubricating oil composition having the following advantages. That is, the composition can be used as a sliding surface oil markedly improved in its properties. For example, the kinetic coefficient of friction is low and no stick slip occurs even if surface pressure of the sliding surface is high. It can be used as a metal working oil such as cutting and grinding oil markedly improved in wear resistance, emulsifiability and solubilizability and stability. Furthermore, it can be used as a sliding surface oil and metal working oil which is conspicuously excellent in secondary properties such as rust proofness, corrosion resistance, oil stain resistance, germ resistance (bacteria resistance, fungus resistance), rot resistance, etc. Therefore, the undiluted composition as it is can be used suitably as a sliding surface oil and the composition as it is or the composition diluted with water can also be suitably used as a metal working oil such as cutting and grinding oil. Further, when the composition is used concurrently as a sliding surface oil and as a metal working oil such as cutting and grinding oil, even if the oils are mixed with each other, there occur no deterioration of properties and inferior actuation and thus the composition can be used as a lubricating oil having both the uses mentioned above.

Furthermore, the sliding surface and metal working lubricating oil composition of this invention has superior characteristics even when it contains no or only a small amount of extreme pressure agent or oiling agent which are ordinarily considered essential for improvement of boundary lubricity, etc. and thus this lubricating oil composition is advantageous in economy and production.

The above mentioned superior characteristics and advantages in use can be obtained by using a reaction product of a specific piperazine compound and a specific dibasic acid and mixing each component at a specific proportion.

EXAMPLES 1-6 AND COMPARATIVE EXAMPLES 1-5

Components shown in Table 1 were mixed at the ratio as indicated in Table 1 to prepare lubricating oil compositions having both the uses. The following tests were conducted using these compositions as they were and emulsions thereof.

The mineral oil used was a naphthenic mineral oil and the synthetic oil was α-olefinoligomer.

Test methods (1) Sliding surface test

Measurement of kinetic coefficient of friction (μ) and examination on occurrence of stick slips were carried out by the Idemitsu method [a method in accordance with ASTM D2877-70 with setting the conditions as follows (This method is described in "Idemitsu Tribo Review" Vol. 1, No. 2, Pages 141–144)]

Conditions

Surface pressure: 0.54 Kg/cm$^2$

Sliding speed: 12 mm/min and 160 mm/min

Material of sliding surface: Bed S45C polished steel plate (JIS G4051), Saddle FC-20 scraper surface (JIS G5501)

(2) Oil stain test

5% by weight of distilled water was added to the lubricating oil composition per se, followed by stirring to obtain an emulsion. This emulsion was put between two FC-20 plates (JIS G5501) (30×70×10 mm) and kept at 60° C. for 5 days. Thereafter, the plates were separated and presence of oil stains was examined.

rust in cut material (cut dust) was examined. The cutting test was conducted by cutting FCD-40 (JIS G5502) by a drilling machine using an end mill tool.

TABLE 1

| | | | Example | | | | | | Comparative Examples | | | | |
|---|---|---|---|---|---|---|---|---|---|---|---|---|---|
| | | | 1 | 2 | 3 | 4 | 5 | 6 | 1 | 2 | 3 | 4 | 5 |
| Results | *6 | Mineral oil | 75.8 | 64.8 | 69.8 | 69.8 | 64.8 | | 65 | 60 | 78 | 75 | Commercial Product |
| | [A] | Synthetic oil | | | | | | | | | | | |
| | *6 | Reaction product 1 *1 | 10 | 15 | | 15 | 25 | | | | | 15 | |
| | [B] | Reaction product 2 *2 | | | 15 | | | 5 | | | | | |
| | | Reaction product 3 *3 | | | | | | | 15 | 20 | | | |
| | *6 | Sulfurized lard | 3 | 10 | | 2 | | | 10 | | | 10 | |
| | [C] | Phosphoric acid ester amine salt | 1 | | 5 | 3 | | 10 | | 10 | 12 | | |
| Composition | *6[D] | Mixed emulsion *4 | 10 | 10 | 10 | 10 | 10 | 10 | 10 | 10 | 10 | — | |
| | Others | Benzotriazole | 0.2 | 0.2 | 0.2 | 0.2 | 0.2 | 0.2 | 0.2 | 0.2 | 0.2 | 0.2 | |
| | *7 | Sliding surface test | | | | | | | | | | | |
| | | Kinetic coefficient of friction at 12 mm/min | 0.12 | 0.12 | 0.12 | 0.13 | 0.13 | 0.13 | SS | SS | SS | Test was impossible (separation) | SS |
| | | Oil stain | no | no | no | no | no | slight | no | no | | — | slight |
| | | Copper strip corrosion | 1a | 1b | 1a | 1a | 1a | 1a | 1b | 1a | 1a | — | 1a |
| | *8 | Cutting test | 45 | 40 | 70 | 55 | 77 | 45 | 40 | 78 | 70 | Test was impossible | |
| | | Wear width μm | | | | | | | | | | | 79 |
| | | Initial emulsion test (ml) | 60 | 70 | 50 | 65 | 80 | 55 | 60 | 70 | 25 | 10 (*10) | 35 |
| | | Rust proofing test | | | | | | | | | | | |
| | | Diluted to 20 times | no rust | ← | ← | ← | ← | ← | ← | ← | *9 | | *9 |
| | | Diluted to 30 times | no rust | ← | ← | ← | ← | ← | ← | ← | *9 | | *9 |
| | | Diluted to 50 times | no rust | ← | ← | ← | ← | ← | ← | ← | *9 | | *9 |

Note; SS . . . Stick slip
*6 Component
*7 Undiluted composition
*8 Emusion
*9 Rust occured
*10 Oil layer present
*1 Reaction product of $HOOC(CH_2)_5CH(CH_2)_{10}COOH$ and
$C_2H_5$
N-(2-hydroxyethyl)piperazine (1:1 in molar ratio).
*2 Reaction product of $HOOC(CH_2)_5CH(CH_2)_{10}COOH$ and
$C_2H_5$
N-(2-hydroxypropyl)piperazine (1:3 in molar ratio).
*3 Reaction product of $HOOC(CH_2)_5CH(CH_2)_{10}COOH$ and
$C_2H_5$
diethanolamine (1:3 in molar ratio).
*4 Mixture of polyoxyethylenenonylphenyl ether (n = 2) and polyoxyethylenenonylphenyl ether (n = 4) in nearly equal amounts (weight) (n: average addition mol number)
*5 This indicates degree of corrosion and "1a" means substantially no corrosion and "1b, 2a, 2b, 3a, 3b, 4a, . . . " means development of corrosion in this order.

(3) Copper plate corrosion test

This test was effected in accordance with JIS K2513 under the conditions of 50° C.×3 hours.

(4) Cutting test

This was conducted by carring out cutting using a carbide chip (P20 . . . JIS B4104) by a lathe and measuring the wear of tool (width of wear). Test sample was 3% emulsion and cutting conditions were as follows:

Material; Aluminum alloy casting AC2A (JIS H5202)
Cutting speed: 100 m/min
Feed: 0.1 mm/rev
Notch: 2 mm
Cutting distance: 4800 m (5) Initial emulsion stability 97 ml of water was put in a measuring cylinder of 100 ml and 3 ml of the lubricating oil composition as it is without dilution was introduced therein. After 30 minutes, it was examined whether the oil (the composition per se) separated and floated as an upper layer (initial emulsifiability). In case the composition was dispersed or dissolved in water, volume (solubility) was measured. The composition which can be applied to this invention must not be dispersed in the upper layer and must have dispersion or dissolution rate of at least 30 ml.

(6) Rust proofing test

Cutting test was carried out using samples of various emulsion concentration and after 7 days, formation of

What is claimed is:

1. A lubricating oil composition for lubrication of sliding surfaces and for lubrication of metal working comprising 2–60% by weight of a reaction product of a dibasic acid which has from 16 to 24 carbon atoms and carboxyl groups at both ends as substituents with a piperazine compound; a lubricating oil; 3–30% by weight of an emulsifier; wherein each ratio is based on the weight of the lubricating oil and piperazine compound has the following general formula:

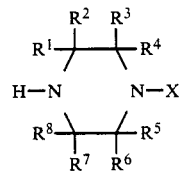

wherein $R^1$–$R^8$ are selected from the group consisting of hydrogen, hydrocarbon groups, hydroxyl groups, halogen, alkoxy groups, amino groups, alkylamino groups, dialkylamino groups, hydrocarbon groups substituted with at least one group selected from the group consisting of halogen, hydroxyl, alkoxy groups, and amino groups; X is selected from the group consisting of hydrogen, hydrocarbon groups, and hydrocarbon groups substituted with at least one group selected from the group consisting of hydroxyl, amino groups, halogen, and alkoxy groups.

2. A lubricating oil composition according to claim 1 wherein the piperazine compound is represented by the following general formula [2]

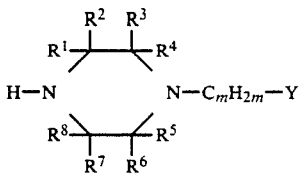

[2]

wherein $R^1$–$R^8$ are selected from the group consisting of hydrogen; hydrocarbon groups, hydroxyl, halogen atoms, alkoxy groups, amino groups, alkylamino groups, dialkylamino groups and hydrocarbon groups substituted with at least one group selected from the group consisting of halogen atoms, hydroxyl, alkoxy groups, and amino groups; Y is selected from the group consisting of OH and $NH_2$; and m represents an integer of 1–5.

3. A lubricating oil composition according to claim 1 wherein the piperazine compound is selected from the group consisting of an N-(hydroxyalkyl)piperazine compound and an N-(aminoalkyl) piperazine compound.

4. A lubricating oil composition according to claim 2 wherein the piperazine compound has at least one substituent selected from the group consisting of a hydroxy lower alkyl group of 1–5 carbon atoms and an amino group-containing lower alkyl group of 1–5 carbon atoms.

5. A lubricating oil composition according to claim 1 wherein the piperazine compound is selected from the group consisting of N-(2-hydroxyethyl)piperazine and N-(2-hydroxypropyl)piperazine.

6. A lubricating oil composition according to claim 1 wherein the dibasic acid is

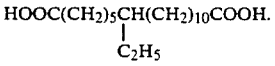

$$HOOC(CH_2)_5\underset{\underset{C_2H_5}{|}}{C}H(CH_2)_{10}COOH.$$

7. A lubricating oil composition according to claim 1 wherein the reaction product is produced by reacting 0.5–10 mol of the piperazine compound with one mol of the dibasic acid of 16–24 carbon atoms at room temperature—200° C. for 5–120 minutes.

8. A lubricating oil composition according to claim 1 wherein the lubricating oil is selected from the group consisting of a mineral oil and a synthetic oil.

9. A lubricating oil composition according to claim 1 wherein a lubricating oil composition additionally contains from 0–30% by weight of an additive selected from the group consisting of an extreme pressure agent and an oiliness agent.

10. A method for lubrication of machine tools which comprises applying a lubricating oil composition both for lubrication of sliding surface and for lubrication in metal working which contains from 2–60% by weight of a reaction product of a dibasic acid having from 16–24 carbon atoms and carboxy groups at both ends as substituents with a piperazine compound, a lubricating oil, from 3–30% by weight of an emulsifier and applying said lubricating oil composition which is diluted by adding 2–200 parts by weight of water per one part by weight of the composition to the metal working part of machine tools.

11. A method for lubrication of machine tools according to claim 10 wherein the piperazine compound is represented by the following general formula [1]

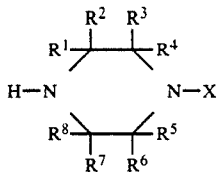

[1]

wherein $R^1$–$R^8$ are selected from the group consisting of hydrogen; hydrocarbon groups, hydroxyl, halogen atoms, alkoxy groups, amino groups, alkylamino groups, dialkylamino groups and hydrocarbon group substituted with at least one group selected from the group consisting of halogen, hydroxyl, alkoxy groups and amino groups, X is selected from the group consisting of hydrogen, hydrocarbon groups and hydrocarbon group substituted with at least one group selected from the group consisting of hydroxyl, amino groups, halogen and alkoxy groups.

12. A method for lubrication of machine tools according to claim 10 wherein the piperazine compound is represented by the following general formula [2]

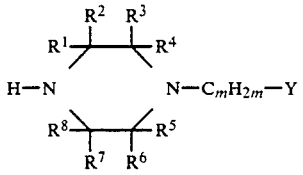

[2]

wherein $R^1$–$R^8$ are selected from the group consisting of hydrogen; hydrocarbon groups; hydroxyl, halogen, alkoxy groups, amino groups, alkylamino groups, dialkylamino groups and hydrocarbon groups substituted with at least one group selected from the group consisting of halogen, hydroxyl, alkoxy groups and amino groups, Y is selected from the group consisting of OH and $NH_2$ and m represents an integer of 1–5.

13. A method for lubrication of machine tools according to claim 10 wherein the piperazine compound is selected from the group consisting of an N-(hydroxyalkyl)piperazine compound and an N-(aminoalkyl)piperazine compound.

14. A method for lubrication of machine tools according to claim 10 wherein the piperazine compound has at least one substituent selected from the group consisting of a hydroxy lower alkyl group of 1–5 carbon atoms and an amino group-containing lower alkyl group of 1–5 carbon atoms.

15. A method for lubrication of machine tools according to claim 10 wherein the piperazine compound is selected from the group consisting of N-(2-hydroxyethyl)piperazine and N-(2-hydroxypropyl)piperazine.

16. A method for lubrication of machine tools according to claim 10 wherein the dibasic acid is $$HOOC(CH_2)_5\underset{\underset{C_2H_5}{|}}{C}H(CH_2)_{10}COOH.$$

17. A method for lubrication of machine tools according to claim 11 wherein the reaction product is produced by reacting 0.5–10 mol of the piperazine compound with one mol of the dibasic acid of 16–24 carbon atoms at room temperature—200° C. for 5–120 minutes.

18. A method for lubrication of machine tools according to claim 12 wherein the lubricating oil is selected from the group consisting of a mineral oil and a synthetic oil.

19. A method for lubrication of machine tools according to claim 10 wherein a lubricating oil composition additionally contains an additive selected from the group consisting of an extreme pressure agent and an oiliness improver.

* * * * *